US006889452B2

(12) United States Patent
Ailey et al.

(10) Patent No.: US 6,889,452 B2
(45) Date of Patent: May 10, 2005

(54) INSOLE FOR FOOTWEAR

(75) Inventors: James H. Ailey, Gainesville, TX (US); Glenn H. Middleton, Garland, TX (US); John G. Pearce, Fort Worth, TX (US); Sharon L. Moure, Haslet, TX (US); Wallace McNeil, St. Louis, MO (US); Hans Hansen, Gerald, MO (US)

(73) Assignee: Boot Royalty Company, L.P., Ft. Worth, TX (US)

( * ) Notice: Subject to any disclaimer, the term of this patent is extended or adjusted under 35 U.S.C. 154(b) by 74 days.

(21) Appl. No.: 09/992,463

(22) Filed: Nov. 14, 2001

(65) Prior Publication Data

US 2003/0088999 A1 May 15, 2003

(51) Int. Cl.[7] ..... A43B 13/38; A43B 23/00; A43B 13/14

(52) U.S. Cl. ..... 36/44; 36/30 R; 36/31

(58) Field of Search ..... 36/43, 44, 102, 36/103, 28, 30 R, 31

(56) References Cited

U.S. PATENT DOCUMENTS

| | | | | | |
|---|---|---|---|---|---|
| 429,480 | A | * | 6/1890 | Morgan | 36/44 |
| 2,231,551 | A | * | 2/1941 | Sewall | 36/44 |
| 2,252,417 | A | * | 8/1941 | Sewall | 36/44 |
| 2,928,193 | A | * | 3/1960 | Kristan | 36/44 |
| 3,835,558 | A | * | 9/1974 | Revill | 36/44 |
| D254,818 | S | | 4/1980 | Jones | |
| 4,439,934 | A | | 4/1984 | Brown | |
| 4,541,184 | A | | 9/1985 | Leighton | |
| D287,302 | S | | 12/1986 | Peterson | |
| 4,633,598 | A | * | 1/1987 | Moronaga et al. | 36/44 |
| 4,722,946 | A | | 2/1988 | Hostettler | |
| 4,808,469 | A | | 2/1989 | Hiles | |
| D302,764 | S | | 8/1989 | Peoples et al. | |
| 4,876,805 | A | | 10/1989 | Peoples | |
| 4,910,886 | A | | 3/1990 | Sullivan et al. | |
| 4,980,386 | A | | 12/1990 | Tiao et al. | |
| 5,014,041 | A | * | 5/1991 | Rosen | 36/43 |
| 5,014,706 | A | | 5/1991 | Philipp | |
| 5,077,915 | A | * | 1/1992 | Gross | 36/30 R |
| 5,093,379 | A | | 3/1992 | Tiao et al. | |
| D342,374 | S | | 12/1993 | Wang | |
| 5,282,326 | A | | 2/1994 | Schroer, Jr. et al. | |
| 5,327,664 | A | | 7/1994 | Rothbart | |
| D352,158 | S | | 11/1994 | Brown | |
| 5,388,349 | A | | 2/1995 | Ogden | |
| 5,463,824 | A | | 11/1995 | Barna | |
| 5,542,196 | A | | 8/1996 | Kantro | |
| 5,727,336 | A | | 3/1998 | Ogden | |
| D396,138 | S | | 7/1998 | Roy | |
| D396,948 | S | | 8/1998 | Moore et al. | |
| 5,787,610 | A | | 8/1998 | Brooks | |
| 5,958,546 | A | | 9/1999 | Mardix et al. | |
| 5,964,046 | A | | 10/1999 | Brooks | |
| 6,026,599 | A | | 2/2000 | Blackwell et al. | |
| D423,202 | S | | 4/2000 | Lubart | |
| 6,070,342 | A | | 6/2000 | Brown | |
| 6,098,319 | A | | 8/2000 | Epstein | |
| 6,205,683 | B1 | * | 3/2001 | Clark et al. | 36/30 R |
| 6,205,685 | B1 | * | 3/2001 | Kellerman | 36/44 |
| 6,226,895 | B1 | | 5/2001 | McClelland | |

FOREIGN PATENT DOCUMENTS

| | | |
|---|---|---|
| WO | WO 92/19191 A1 | 11/1992 |
| WO | WO 98/31248 A1 | 7/1998 |

* cited by examiner

*Primary Examiner*—Anthony D. Stashick
(74) *Attorney, Agent, or Firm*—Thompson & Gustavson, L.L.P.

(57) ABSTRACT

An insole for footwear that is capable of providing a protective layer between a plantar surface of a human foot and an upper surface of a sole of the footwear. The insole can have a first portion positioned in a rearfoot region of the insole and a second portion positioned at a forefoot portion of the insole, wherein the second portion can be more flexible than the first portion. The insole may further include a toe piece positioned in a toe region of the insole and a footbed that overlays the first portion of the insole, the second portion of the insole, and the toe piece of the insole.

4 Claims, 3 Drawing Sheets

INSOLE FOR FOOTWEAR

FIELD OF THE INVENTION

The present invention relates to an insole for footwear, and the footwear incorporating the insole.

BACKGROUND OF THE INVENTION

Conventional footwear are generally provided with an insole positioned on the upper surface of the sole of the footwear. The insole is generally affixed to the upper surface of the sole of the footwear and provide a protective layer of material between the foot of the user and the upper surface of the sole of the footwear.

Conventionally, the insoles used in the footwear are formed of a surface lining and a harder and more rigid lining below the surface lining. The surface lining is generally adhesively secured to the more rigid lining, and the combination layer of the surface lining and the rigid lining is secured to the upper surface of the sole of the footwear by adhesives, sewing, nailing, or other conventional methods of attaching the insole to the surface of the sole of the footwear.

Conventional footwear construction incorporating insoles, as described above, fail to provide both sufficient cushioning and adequate flexibility. More specifically, because the insoles are constructed to primarily provide separation and a protective layer between a wearer's foot and the upper sole of the footwear device, the insoles are generally constructed with very little or no cushioning, and further, due to the rigidity of the materials that form the insole layer, flexibility is limited.

Furthermore, in a ball-to-ball, or ¾ welt, footwear construction, in particular, conventional insoles fail to provide cushioning to comfortably support the entire plantar surface of a human foot. More specifically, in the construction of ball-to-ball footwear, a shank portion, or the region of the footwear and the corresponding region of the insole forward of the heel area and rearward of the forefoot area, is narrowed in comparison to a full welt footwear construction. According to such construction, the insole is stitched to an outsole of the footwear from an area corresponding to a ball area of a foot at a medial side of the footwear, to an area corresponding to a ball area of the foot at a lateral side of the footwear, around the periphery of the outsole of the footwear. It is also customary to secure the shank portion of the insole on the inner surface of the sole of the footwear by using holding members, for example, nails or staples, which are generally driven upwardly from the outer sole of the footwear.

Due to the previously described construction, it is necessary for the insole to be formed of a material that is capable of retaining the holding member. Thus, materials that are rigid and which resist flexibility are used to retain the holding members. According to such construction, however, cushioning is omitted from the footwear in order to provide a layer that can retain the holding members. As a result, such footwear construction fails to provide sufficient cushion and comfort to a user.

Accordingly, conventional insoles have been unable to meet both the construction requirements and the comfort requirements necessary to provide both a sturdy construction as well as adequate comfort for a wearer. Thus, there exists a need for an insole that is capable of providing both comfort and flexibility.

BRIEF SUMMARY OF THE INVENTION

Accordingly, the present invention provides an insole that provides sufficient cushioning and flexibility.

In one aspect of the invention, an insole having a rearfoot region and a forefoot region, and bounded by a periphery having a medial edge, a lateral edge, a rearward edge, and a forward edge, comprises a base strip that has a first portion positioned at the rearfoot region of the insole and a second portion positioned at the forefoot region of the insole, wherein the second portion is more flexible than the first portion.

In another aspect of the invention, an insole is bounded by a periphery having a medial edge, a lateral edge, a rearward edge, and a forward edge and corresponds substantially to a plantar surface of a human foot. The insole further has a rearfoot region, a forefoot region, and a toe region and comprises a base strip having a first portion positioned at the rearfoot region of the insole, and a second portion positioned at the forefoot region of the insole, and a toe piece positioned at the toe region of the insole, wherein the second portion of the base strip is more flexible than the first portion of the base strip.

In another aspect of the invention, an insole is bounded by a periphery having a medial edge, a lateral edge, a rearward edge, and a forward edge and corresponds substantially to a plantar surface of a human foot. The insole has a rearfoot region, a forefoot region, and a toe region and comprises a base strip which has a first portion that can be positioned at the rearfoot region of the insole and a second portion that can be positioned at the forefoot region of the insole, a toe piece that can be positioned at the toe region of the insole, and a footbed that is positioned on each of the base strip and the toe piece, wherein the second portion of the base strip is more flexible than the first portion of the base strip. Further, a third portion having a shape corresponding substantially to the shape of the first portion is positioned in contact with the first portion and forms, with the second portion and the toe piece, the bottom surface of the insole.

In a further aspect of the invention, a footwear comprises a sole, a footwear upper portion attached to the sole to form a foot receiving member capable of retaining a human foot, and an insole positioned on an inner surface of the sole and having a rearfoot region and a forefoot region, and bounded by a periphery having a medial edge, a lateral edge, a rearward edge, and a forward edge. The insole further comprises a base strip having a first portion that can be positioned at the rearfoot region of the insole and a second portion that can be positioned at the forefoot region of the insole, wherein the second portion is more flexible than the first portion.

In another aspect of the invention, because a footbed of an insole is formed substantially of the same material throughout its entirety, the positioning of different portions of a strip underlaying the footbed will determine which portions of the insole will be more flexible relative to other portions of the insole.

In another aspect of the invention an insole comprises a base strip provided in a rearfoot region of the insole and a forefoot region of the insole, wherein the base strip can control flexibility in the rearfoot region and the forefoot region of the insole.

In another aspect of the invention an insole comprises a footbed having a rearfoot region, a forefoot region, and a toe region and bounded by a periphery having a medial edge, a lateral edge, a rearward edge, and a forward edge, and a strip underlaying at least a portion of the footbed, wherein the strip can control flexibility in the rearfoot region, the forefoot region, and the toe region of the insole.

BRIEF DESCRIPTION OF THE DRAWINGS

Other advantages and features of the invention will become more apparent with reference to the following detailed description of the presently preferred embodiment thereof in connection with the accompanying drawings, wherein like reference numbers have been applied to like elements, in which.

DETAILED DESCRIPTION OF THE INVENTION

Figure 1:
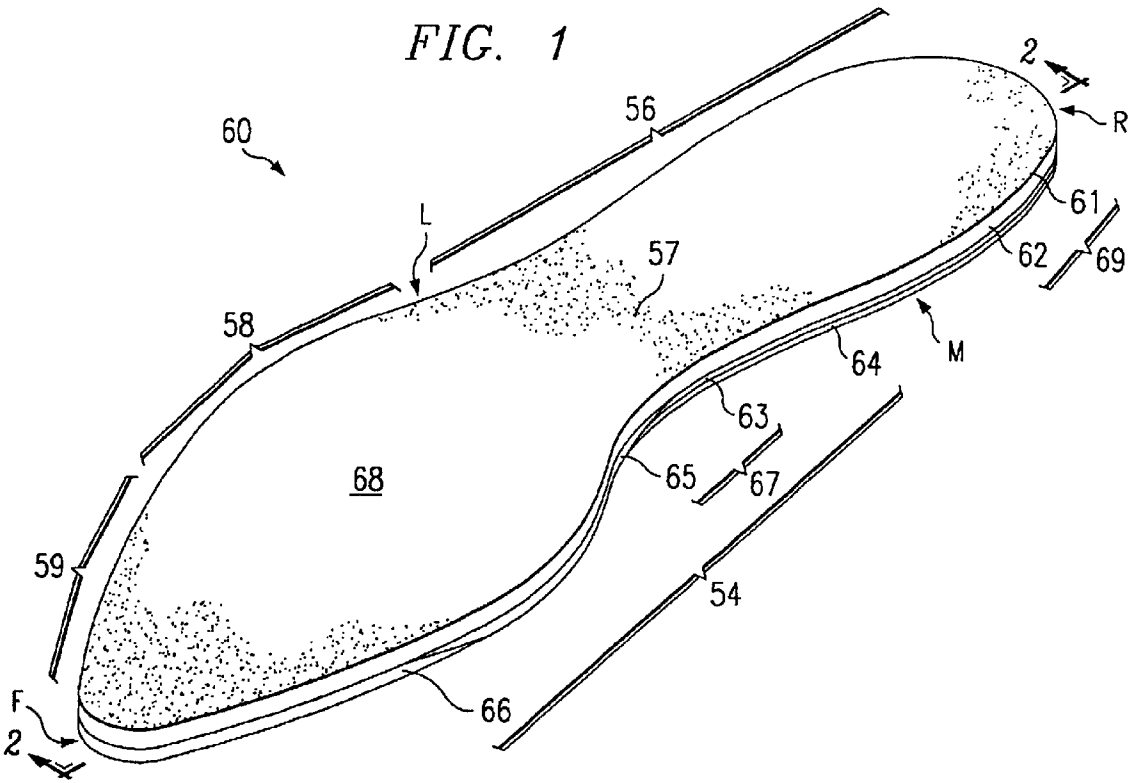
FIG. 1 is a perspective view of an upper surface of an insole according to an embodiment of the present invention.

The present invention will now be described with reference to the drawings. FIG. 1 illustrates an insole 60 for use in a shoe, boot, or other footwear, according to one embodiment of the invention. Insole 60 is preferably constructed with a medial edge M, a lateral edge L, a rearward edge R, and a forward edge F. More specifically, in a preferred embodiment, insole 60 extends from rearward edge R to forward edge F, and has a variable width from lateral edge L to medial edge M, in a direction from rearward edge R to forward edge F. Preferably, the dimensions and peripheral contour of insole 60 generally correspond to the plantar surface of a human foot such that insole 60 is capable of providing support to substantially an entire plantar surface of a human foot. Although FIG. 1 illustrates an upper surface 68 of insole 60 with a surface contour that is generally uniform throughout the entire length and width of insole 60, it is understood that the upper surface 68 can have various contours.

For purposes of simplicity and ease of reference, insole 60 will be described with reference to a rearfoot region 56, a forefoot or ball region 58, and a toe region 59. Rearfoot region 56 generally describes a portion of the insole beginning at the rearward edge R of insole 60 on which a heel of a foot of a wearer will be positioned, and extends to a rearwardmost portion of forefoot region 58. In particular, rearfoot region 56 includes a shank area 57, which can be described as a transitional part of insole 60 located between forefoot region 58 and a forward portion of rearfoot region 56. Shank area 57 is generally narrower than a rearwardmost part of rearfoot region 56 and narrower than forefoot region 58. Forefoot region 58 corresponds generally to a portion of insole 60 on which the balls or heads of metatarsals one through five of a foot will likely be positioned on insole 60, and the regions of insole 60 that are immediately fore and aft of the position on insole 60 in the vicinity of the position of the metatarsal heads. Toe region 59 generally describes a forwardmost portion of insole 60 corresponding to a region of insole 60 on which the toes of a wearer will be positioned. Toe region 59 extends from an area forward of forefoot region 58 to forward edge F of insole 60.

Although the preceding descriptions will be used to aid in describing the insole of the present invention, the regions described above represent a general description of the regions of the insole, with references to anatomical landmarks of the foot. As will be understood, the above description of insole 60 is with respect to anatomical features of a foot corresponding in size to a size of insole 60, and as such, the size of rearfoot region 56, forefoot region 58, and toe region 59 can vary according to the insole construction and the size of the insole.

Figure 2:
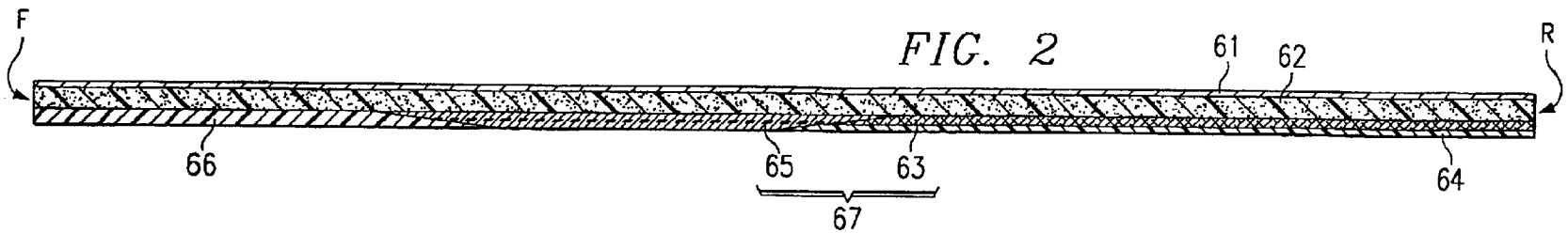
FIG. 2 is a cross-sectional side view of the insole taken along line 2—2 of FIG. 1.

Referring to FIGS. 1 and 2, insole 60 is preferably constructed with a footbed 69 and a lower multicomponent strip 54. As shown in FIGS. 1 and 2, lower multicomponent strip 54 preferably includes a base strip 67, consisting of first tuck 63 and forepart 65. In the illustrated embodiment of FIG. 2, base strip 67 at least partially underlies footbed 69. Lower strip 54 further includes a toe piece 66 and a second tuck 64. As will be explained, according to the present embodiment, the construction of lower strip 54 controls the flexibility of the different regions of insole 60, and in particular, the flexibility of rearfoot region 56 and forefoot region 58. More specifically, because footbed 69 is formed of the same materials substantially throughout its entirety, the positioning the different components of strip 54 will determine which portions of footbed 69 of insole 60 will be more flexible relative to other portions of insole 60.

Footbed 69 preferably includes a surface portion 61 and an intermediate portion 62 underlying surface portion 61. In a preferred embodiment, footbed 69 and lower strip 54 can extend substantially the entire length and width of insole 60, and are capable of supporting substantially the entire plantar surface of a human foot.

Surface portion 61 of footbed 69 is preferably formed of a leather or a textile lining, such as is suitable and known in the art. Surface portion 61 can be provided on an upper surface 68 of insole 60 to form a protective layer directly beneath the plantar surface of a human foot, when the insole is in use. In a preferred embodiment, surface portion 61 is preferably a lining material with a smooth and durable finish. Surface portion 61 can also be provided with other properties. For example, surface portion 61 can be treated to provide odor-resistant properties, and can be constructed to be pilling resistant and/or moisture resistant.

Intermediate portion 62 of footbed 69 preferably underlies surface portion 61, and is preferably formed of a soft material that is capable of providing cushioning and shock-absorption. Intermediate portion 62 can also be provided to resist permanent compression of insole 60, and therefore, can extend the effective life of insole 60. In one embodiment, intermediate portion 62 is formed of a soft and flexible foam material with a density in a range of about 8 $lb/ft^3$ to 16 $lb/ft^3$ according to ASTM 3574 test method. In a preferred embodiment, intermediate portion 62 has a density in the range of about 10 $lb/ft^3$ to about 14 $lb/ft^3$ according to ASTM 3574 test method. Further, intermediate portion 62 may have a compression set percentage that is less than about 10 percent, and it is preferred that intermediate portion 62 has a compression set percentage that is less than about 5 percent, according to ASTM 1667 at 73° F. (22° C.) (room temperature) test. It is understood, however, that any other cushioning material can be used.

Figure 3:
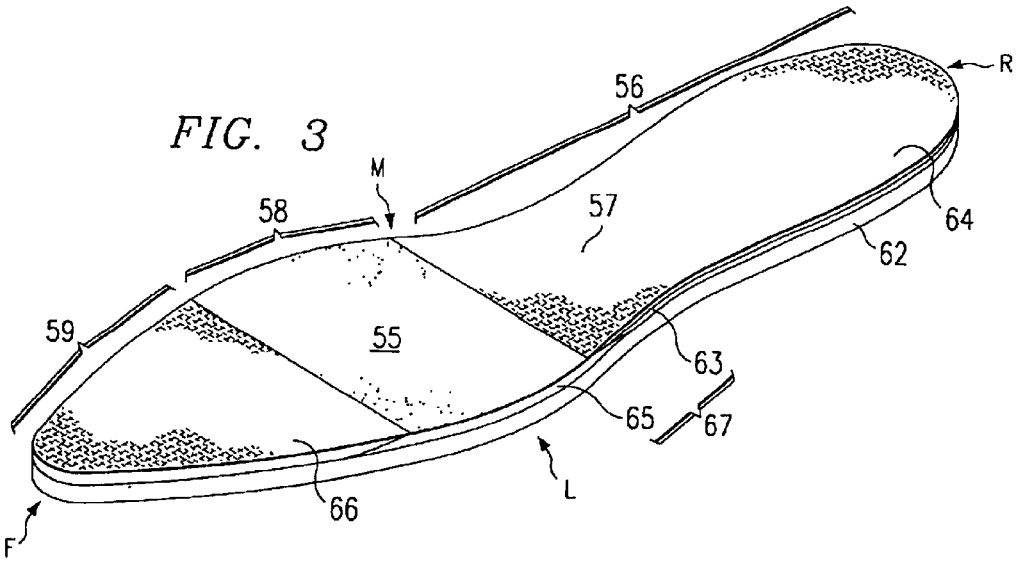
FIG. 3 is a perspective view of a lower surface of the insole of FIG. 1.

Base strip 67, as depicted in FIGS. 1–3, preferably includes first tuck 63 and forepart 65. First tuck 63 can be positioned generally in rearfoot region 56 of insole 60 and preferably extends from rearward edge R to a rearward portion of forefoot region 58, and includes shank area 57 of insole 60. Forepart 65 is preferably provided in forefoot region 58 of insole 60. Both first tuck 63 and forepart 65 can be positioned such that an upper surface of each of first tuck 63 and forepart 65 are in contact with intermediate portion 62. Thus, according to a preferred construction, base strip 67, which includes first tuck 63 and forepart 65, forms a contiguous layer from rearward edge R of insole 60 to the forwardmost part of forefoot region 58, and underlies a portion of footbed 69.

In a preferred embodiment, forepart 65 is constructed with a material that is more flexible than first tuck 63. That is, because forepart 65 will be located in a forefoot region 58 of insole 60, it is preferred that forepart 65 be capable of directionally flexing to accommodate the movement of a human foot and, in particular, to accommodate the flexing and movement caused by a forefoot push off stage of human gait By providing a flexible member in forefoot region 58, insole 60 is able to flex upwardly at a time of forefoot push-off when the heads of the metatarsal bones of the foot in the forefoot region of the foot transfer weight from the heel of the foot to the toes of the foot. Forepart 65 may have a flexing index average value that meets or exceeds 2.7 according to SATRA TM 3 1999. In a preferred embodiment, forepart 65 has a flexing index average value that meets or exceeds 3.7 according to SATRA TM 3 1999.

Accordingly, a wearer experiences greater comfort and less restriction due to the construction of an insole according to the present invention. More specifically, whereas conventional insoles are constructed with rigid materials throughout substantially the entire insole, the present insole can be provided with forepart 65, positioned in forefoot region 58 to allow insole 60 to flex during the different stages of human gait.

In one embodiment, forepart 65 can be made substantially of a flexible material. In a preferred embodiment, forepart 65 is a resilient and flexible material. Forepart 65 can also be provided with moisture and perspiration resistance properties or additives, and can further provide a surface that readily accepts adhesives. In one embodiment, forepart 65 can have a thickness in the range of 0.010 inches to 0.100 inches. In a preferred embodiment, forepart 65 has a thickness in the range of about 0.030 inches to 0.080 inches. Suitable examples of materials from which forepart 65 can be made are those sold under the trademark StanFlex Super 80, made by Stanbee Corporation, and Foss Dura Hinge, made by Foss Manufacturing Company Inc.

Whereas forepart 65 is preferably a flexible material, it is preferred that first tuck 63 is less flexible than forepart 65. In one embodiment, first tuck 63 is a rigid material, and has a density in the range of about 0.0200 ($lb/in^3$) to about 0.0400 ($lb/in^3$). In a preferred embodiment, first tuck 63 has a density in the range of about 0 0330 ($lb/in^3$) to about 0.0380 ($lb/in^3$). Further, it is preferred that first tuck 63 has a nail hold value in the range of about 68–107 (lb.). Additionally, in one embodiment, first tuck 63 has a flexural strength in the range of about 4 5-psi to 6.4-psi. In a preferred embodiment, the flexural strength of first tuck 63 is in the range of about 4.9-psi to 6.0-psi.

According to a preferred embodiment, first tuck 63 and second tuck 64 are positioned such that second tuck 64 underlies substantially the entire lower surface of first tuck 63, and such that the continuous layer formed by first tuck 63 and second tuck 64 is bounded by rearward edge R, lateral edge L, medial edge M, and a rearward portion of forepart 65 of insole 60. The second tuck 64 has a size and shape generally corresponding to a size and shape of first tuck 63. The contiguous layer of first tuck 63 and second tuck 64 is preferably positioned such that first tuck 63 can be in contact with intermediate portion 62, and second tuck 64 can be in contact with the upper surface of the inner sole of footwear in which the insole is positioned. Thus, as shown in FIG. 3, second tuck 64 can form at least part of bottom surface 55 of insole 60.

Toe piece 66 is preferably positioned in toe region 59 to underlay intermediate portion 62, and forms a portion of bottom surface 55 of insole 60. Accordingly, in a preferred embodiment, as can be seen in FIG. 3, bottom surface 55 of insole 60 is formed by, in a direction from a rearward edge to a forward edge, second tuck 64 extending from rearward edge R to a rearward part of forefoot region 58, and including shank area 57, forepart 65 positioned in forefoot region 58, and toe piece 66 positioned in toe region 59 of insole 60. Further, according to one embodiment of the present invention, second tuck 64 and toe piece 66 can be formed of identical materials.

Figure 4:
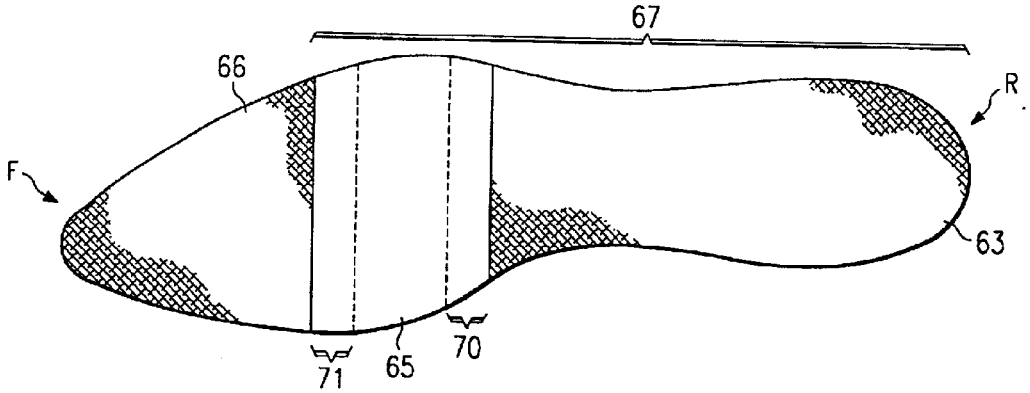
FIG. 4 is a top view of the lower regions of the insole of FIG. 1.
Figure 5:
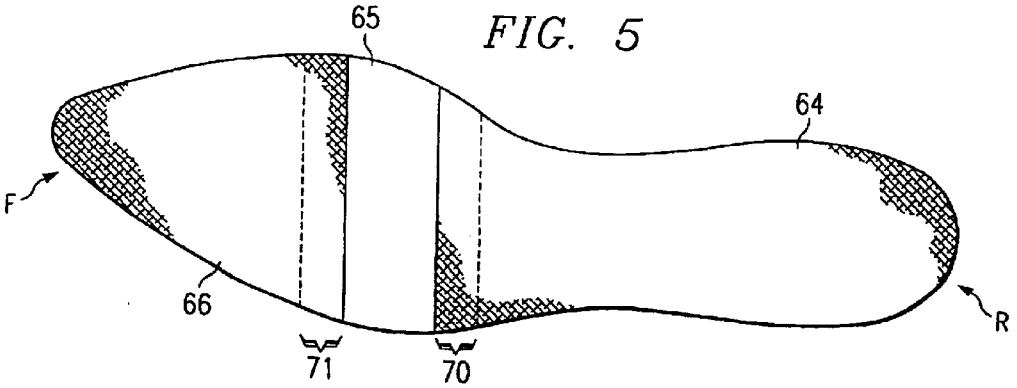
FIG. 5 is a bottom view of the lower region of the insole of FIG. 1.

FIG. 4 illustrates a top view of lower strip 54 of insole 60, i.e., the portion of lower strip 54 directly underlying footbed 69. FIG. 5 illustrates a bottom view of lower strip 54 of insole 60, i.e. the portion of lower strip 54 that will contact an inner surface of a sole of a footwear. In particular, FIG. 4 illustrates, in a direction from forward edge F to rearward edge R, toe piece 66, forepart 65, and first tuck 63. FIG. 5 illustrates lower surface 55 of insole 60 which includes, in a direction from forward edge F to rearward edge R, toe piece 66, forepart 65, and second tuck 64.

In the present invention, it is preferred that the surface contour throughout the entirety of insole 60, including intermediate or transitional areas of lower strip 54 of insole 60, remain substantially uniform. More specifically, it is preferred that ridges that are generally formed on upper surface 68 and bottom surface 55 at overlapping regions of the different segments that form insole 60 are substantially minimized, as such ridges can cause discomfort when the insole is worn. Accordingly, in the preferred embodiment, the edges of each of first tuck 63, second tuck 64, and forepart 65 in a vicinity of a first abutting region 70, which is a region of transition between first tuck 63 and second tuck 64, and forepart 65, are skived. Similarly, the edges of each of forepart 65 and toe piece 66 in the vicinity of a second abutting region 71, which is a region of transition between forepart 65 and toe piece 66, are skived. That is, the forwardmost edges of the contiguous layer of first tuck 63 and second tuck 64 in the vicinity of first abutting region 70, and a rearwardmost edge of forepart 65 can each be shaved, or cut in any suitable manner, at an angle such when the shaved edges of first and second tuck 63, 64 are joined to the rearwardmost edge of forepart 65 at first abutting region 70, the height, or thickness of base strip 67 at first abutting region 70 remains generally consistent with the height, or thickness of the regions immediately fore and aft of first abutting region 70.

Similarly, each of the edges of toe piece 66 and forepart 65 in the vicinity of second abutting region 71 can also be provided with skived edges, as described above with respect to first abutting region 70. In a preferred embodiment, a rearwardmost edge of toe piece 66 can be shaved at an angle, and a forwardmost edge of forepart 65 can be shaved at an angle such that when brought together, the shaved edges of toe piece 66 and forepart 65 align, and the combined height, or thickness, of toe piece 66 and forepart 65 in the vicinity of second abutting region 71 is consistent with the height of the regions immediately fore and aft of second abutting region 71.

According to the above description of first abutting region 70 and second abutting region 71, the height or thickness at any single widthwise region of upper surface 68 and bottom surface 55 is consistent with the thickness of the regions that are immediately fore and aft of that particular region of insole 60. Thus, the presence of ridges that are formed due to portions of insole 60 being thicker than other portions in an immediate vicinity are minimized.

The above description illustrates only an exemplary way in which the regions of transition between the different portions of insole 60 can be constructed. It is understood, however, that the description above does not limit the invention, and that other constructions can be used in the regions of transition between the different portions of insole 60.

Figure 6:
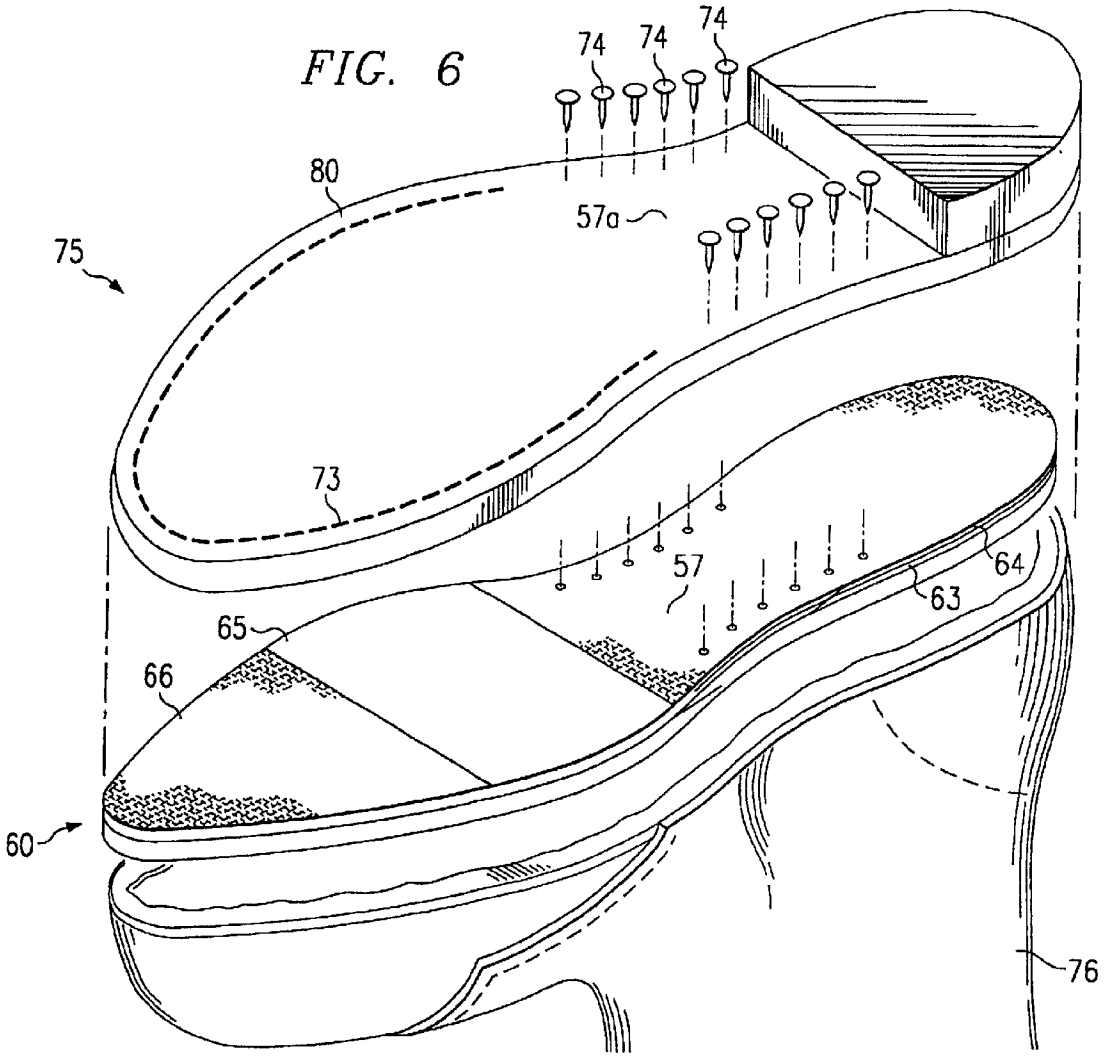
FIG. 6 is an exploded view of a footwear construction incorporating an insole of the present invention.

In the construction of base strip 67, described above, the positioning of forepart 65 in forefoot or ball region 58 assists in the flexibility of insole 60. Additionally, the present invention may be incorporated in a footwear construction, as illustrated in FIG. 6, wherein a shank area 57*a* of a footwear 75 is narrowed, compared to other conventional footwear construction, and outsole stitching 73 is used around the periphery of footwear 75 from a ball region at a medial edge of the footwear to a ball region at a lateral edge of footwear 75 to secure an insole and a footwear upper 76 to an inner surface of sole 80. In this construction, holding members, such as tacks 74, are generally used to secure the insole to the shank area 57*a* of an inner surface of sole 80 of footwear 75.

According to a preferred construction of insole 60, first tuck 63 and second tuck 64 can extend from a rearward edge of insole 60 to a forward edge of shank area 57. In this way, the combination of first tuck 63 and second tuck 64 forms a suitable retaining bed for tacks 74, such that insole 60 is adequately held against sole 80 of footwear 75. Thus, a foot receiving member is formed including footwear upper 76 and insole 60, which is held fixedly against an inner surface of sole 80 of footwear 75.

Thus, unlike conventional insoles, the insole of the present invention, with forepart 65 and first and second tuck 63, 64, can provide the rigidity necessary for tacks or other holding members to be used to retain the insole against a surface of a sole of a footwear device, and the flexibility and cushioning desired for providing comfort to a wearer.

According to a construction of the above described embodiment of insole 60, each of first tuck 63, second tuck 64, forepart 65, toe piece 66, intermediate portion 62, and surface portion 61 can be cut or shaped by any method to correspond to a predetermined size. That is, each element of insole 60 can be cut and shaped according to predetermined parameters that correspond to a size of a footwear and a size of a foot that will mate with insole 60. Further, the portions of toe piece 66 and forepart 65 in the second abutting region 71, along with the portions of forepart 65, first tuck 63 and second tuck 64 in first abutting region 70 can be skived or shaved in any order, and the different portions of the insole can be combined by any method of combining.

Although the present invention has been described with reference to a presently preferred embodiment, it will be appreciated by those skilled in the art that various modifications, alternatives, variations, and substitution of parts and elements, may be made without departing from the spirit of the invention. Thus, the present application is intended to cover such modifications, alternatives, variations and elements as fall within the scope of the appended claims.

What is claimed is:

1. An insole bounded by a periphery having a medial edge, a lateral edge, a rearward edge, and a forward edge and corresponding substantially to a plantar surface of the human foot, said insole having a rearfoot region, a forefoot region, and a toe region and comprises:

a base strip having a first portion that can be positioned at said rearfoot region of said insole and a second portion that can be positioned at said forefoot region of said insole, the second portion having a flexing index average value that meets or exceeds 2.7 according to SATRA TM3 1999, and a thickness in the range of 0.010 to 0.100 inches, while the first portion has a density in the range of about 0.0200 (lb/cubic in) to 0.0400 (lb/cubic in) and a nail hold value in the a toe piece that can be positioned at said toe region of said insole; and a footbed positioned on each of said base strip and said toe piece, wherein said second portion of said base strip is more flexible than said first portion of said base strip.

2. An insole according to claim 1 wherein the footbed includes a surface portion formed of a leather or textile lining, and an intermediate portion formed of a soft and flexible foam material with a density in the range of about 8 lb/cubic ft to 16 lb/cubic ft according to the ASTM 3574 test method and a compression set percentage that is less than about 10 percent according to ASTM 1667 at 73 degrees F.

3. An insole according to claim 1 wherein the first portion has a flexural strength in the range of about 4.5 psi to 6.4 psi.

4. The insole according to claim 1 further comprising a third portion having a shape corresponding substantially to the shape of said first portion and positioned in contact with said first portion, wherein said third portion, said second portion and said toe piece form part of a lower surface of said insole.

* * * * *

UNITED STATES PATENT AND TRADEMARK OFFICE

CERTIFICATE OF CORRECTION

PATENT NO. : 6,889,452 B2
APPLICATION NO. : 09/992463
DATED : May 10, 2005
INVENTOR(S) : James H. Ailey et al.

It is certified that error appears in the above-identified patent and that said Letters Patent is hereby corrected as shown below:

Column 5, line 46, “about 0 0330” should be changed to -- about 0.0330 -- .

Column 5, line 50, “about 4 5-psi” should be changed to -- about 4.5-psi --.

Column 8, line 25, add -- range of 68-107 lbs; -- after “value in the”.

Signed and Sealed this

Nineteenth Day of December, 2006

JON W. DUDAS
*Director of the United States Patent and Trademark Office*